US007989046B2

(12) United States Patent
DiNunzio

(10) Patent No.: US 7,989,046 B2
(45) Date of Patent: Aug. 2, 2011

(54) PROTECTIVE COVERING FOR A PRIVACY CURTAIN

(76) Inventor: Robert DiNunzio, Voorhees, NJ (US)

( * ) Notice: Subject to any disclaimer, the term of this patent is extended or adjusted under 35 U.S.C. 154(b) by 313 days.

(21) Appl. No.: 12/386,893

(22) Filed: Apr. 24, 2009

(65) Prior Publication Data

US 2010/0272947 A1 Oct. 28, 2010

(51) Int. Cl.
*B65D 65/12* (2006.01)

(52) U.S. Cl. ..... 428/99; 428/124; 160/237; 160/330; 29/402.03

(58) Field of Classification Search ..... 428/99, 428/124; 150/154; 160/237, 405, 330, DIG. 6, 160/DIG. 7; 29/402.03
See application file for complete search history.

(56) References Cited

U.S. PATENT DOCUMENTS

2009/0044888 A1* 2/2009 Ganey ..... 150/154
* cited by examiner

*Primary Examiner* — Alexander Thomas
(74) *Attorney, Agent, or Firm* — Stuart M. Goldstein

(57) ABSTRACT

A protective covering is readily installed on and removeable from standard privacy curtains. The covering is made of a disposable sheet material having two sections interconnected by a crease. The two sections are positioned over the side surfaces of the curtain, the edge of the curtain being located within the crease. Attachment of the curtain is accomplished by snap connectors which extend through the upper mesh section of the privacy curtain and adhesive components which adhere to the side surfaces of the curtain.

7 Claims, 2 Drawing Sheets

PROTECTIVE COVERING FOR A PRIVACY CURTAIN

BACKGROUND OF THE INVENTION

Privacy curtains are most often used in hospitals and other health care facilities, especially when multiple patients occupy a common space. Such curtains usually comprise a main, lower privacy section made of opaque material, and a meshed upper section. The curtains are routinely hung from ceiling tracks, so that they can be easily moved and positioned around a given patient's space, as the dictates of privacy require. The user opens and closes the curtains simply by holding onto the curtain's edge and pulling or pushing the curtain as it travels around the ceiling track.

However, in a hospital or like healthcare facility, where a clean and germ free environment is of primary importance, repeated touching of the privacy curtain presents an invitation for infection. The curtain will become contaminated, as various users, both medical staff and visitors, grab the edges to open and close it during day-to-day operations. Privacy curtains are expensive, so they are rarely replaced and lack of time and resources prevent their being laundered between patients. As a practical matter, in many cases, they are often never properly cleaned. Thus, privacy curtains become a prime source for the potential spreading of infection in environments that can ill afford this threat.

SUMMARY OF THE INVENTION

It is thus an object of the present invention to provide a means to control the contamination of privacy curtains and the ensuing spread of infection on such curtains.

It is the object of the present invention to provide a protective covering to be installed over the handheld edges of privacy curtains to prevent contamination of the curtain.

It is another object of the present invention to provide a protective covering for a privacy curtain which is easily installed and removed from the edge of the curtain.

It is a further object of the present invention to provide a protective covering for a privacy curtain which can easily be removed from the curtain and disposed of to prevent the spread of infection.

It is a further object of the present invention to provide a protective covering for a privacy curtain which is made of readily available material, easily disposed of and economical to manufacture, for ready replacement of the covering on the curtain.

It is another object of the present invention to provide a protective covering for a privacy curtain which is compatible for use with most standard privacy curtains.

It is still another object of the present invention to provide a protective covering for a privacy curtain which represents a cost efficient and effective way to assist with preventing the potential spread of infection caused by hand contact.

These and other objects are accomplished by the present invention, a protective covering readily installed on and removeable from standard privacy curtains. The covering is made of a disposable sheet material having two sections interconnected by a crease. The two sections are positioned over the side surfaces of the curtain, the edge of the curtain being located within the crease. Attachment of the curtain is accomplished by snap connectors which extend through the upper mesh section of the privacy curtain and adhesive components which adhere to the side surfaces of the curtain.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
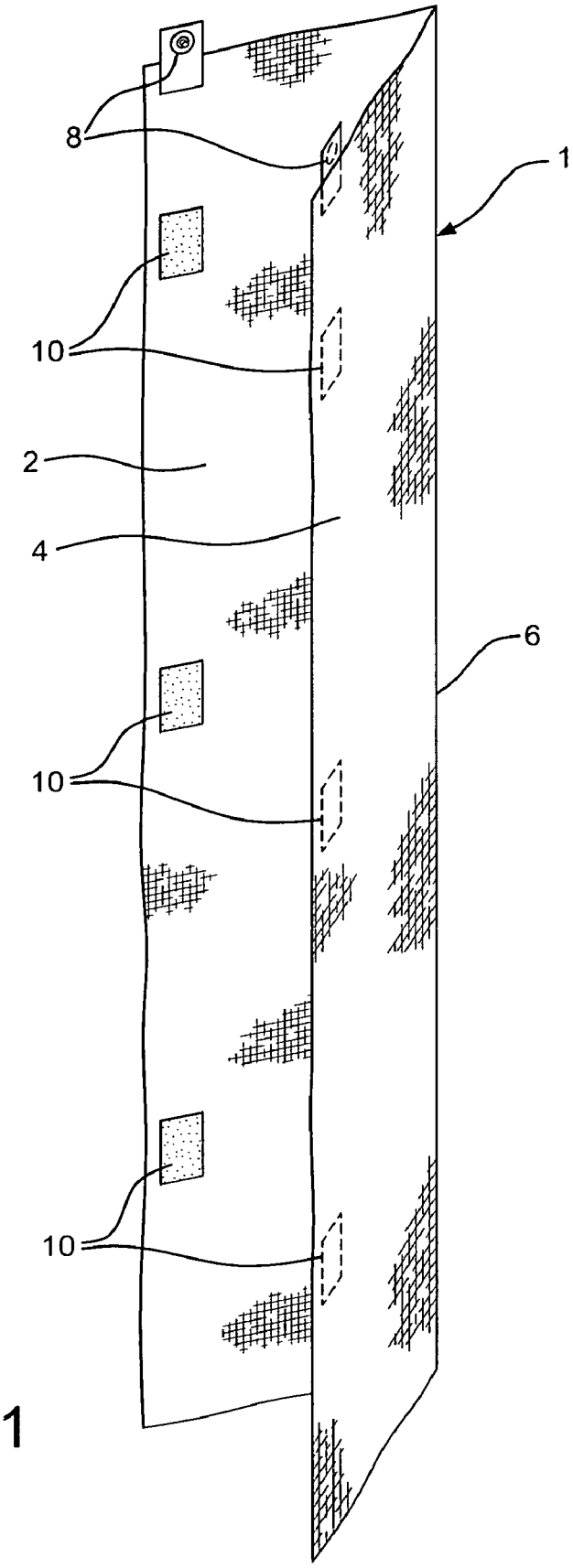
FIG. 1 is a perspective view of the protective covering of the present invention.

Protective covering 1 comprises a sheet of flexible, disposable material. Favored material which can be used include lightweight fabric, synthetic plastics, heavy paper, flexible light cardboard, or their equivalents. The present invention is not to be considered restricted by the particular material used.

Protective covering 1 comprises lateral sections 2 and 4 which are interconnected by edge or crease 6. Sections 2 and 4 and crease 6 extend the full length of covering 1. Snap members 8 are located at the top of covering 1 and adhesive strips 10 are positioned along the internal edges of sections 2 and 4.

Figure 2:
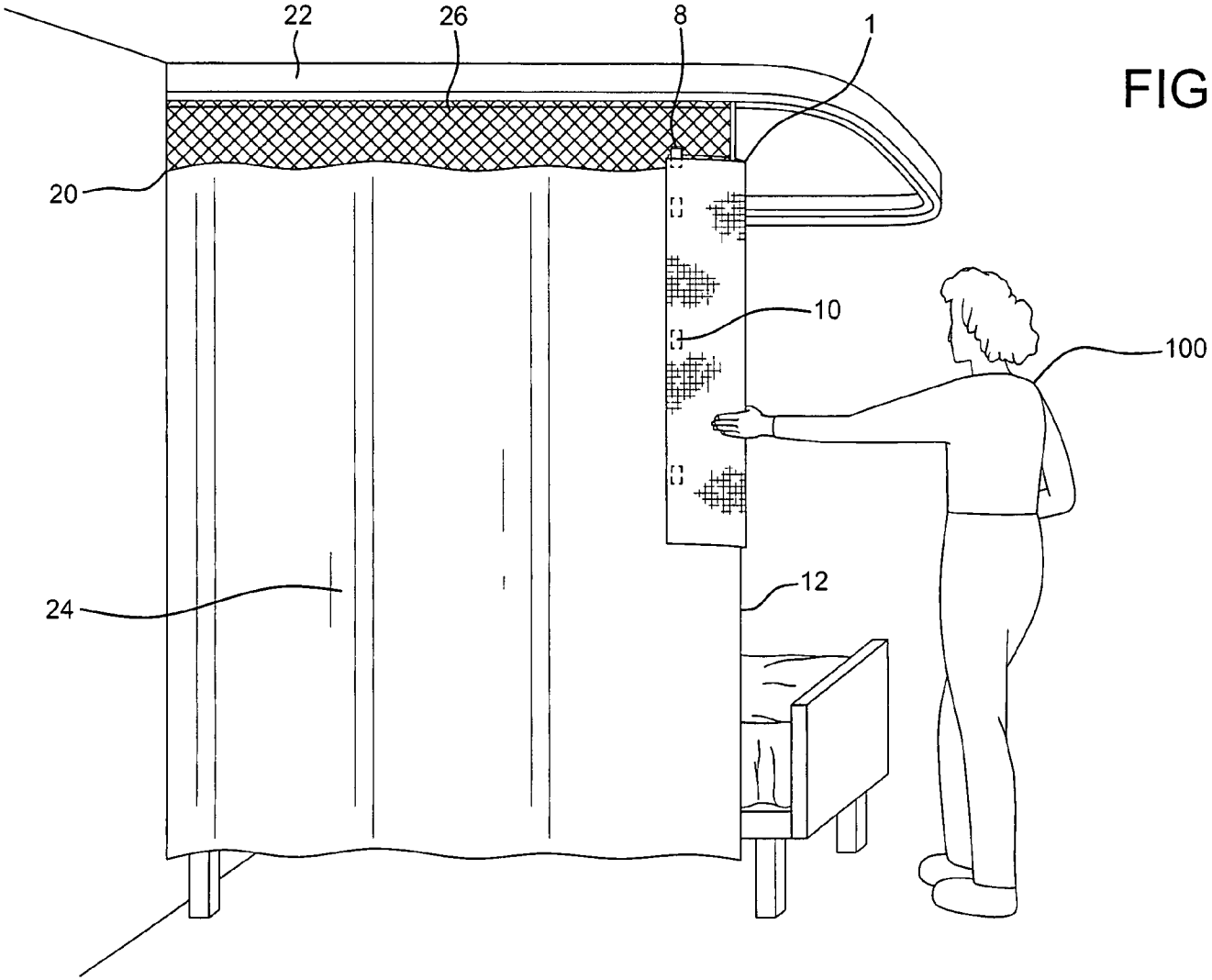
FIG. 2 shows the protective covering of the present invention in place for use on a privacy curtain.

FIG. 2 shows protective covering 1 in use on privacy curtain 20. Privacy curtain 20, moveably hung from ceiling track 22, comprises lower opaque privacy section 24 having internal and external side surfaces, and upper meshed section 26 attached to track 22.

Covering 1 is positioned over privacy curtain 20, with lateral sections 2 and 4 being placed on and around the side surfaces of lower opaque section 24 of the curtain, such that a segment of lateral edge 12 of the curtain is located within crease 6 of the covering. Covering 1 is then removeably attached to curtain 20 by snap means 8 extending through upper mesh section 26 of the curtain and by positioning adhesive strips 10 on the side surfaces of opaque section 24.

Protective covering 1, as attached to privacy curtain 20 as shown in FIG. 2, will be the portion of the curtain which user 100 holds onto to move the curtain around track 22. Thus protective covering 1 becomes the handheld component of the curtain. In this manner, any germs, infection, or contamination from the hand of user 100 will be confined to the protective covering. Rather than washing or otherwise replacing privacy curtain 20 between patients, or if the edge of the curtain becomes soiled, protective covering 1 can simply be removed from the curtain by detaching snaps 8 and pulling the protective covering from the side of the curtain, adhesive strips 10 allowing it to be easily detached from the curtain. A fresh new protective covering 1 can then be reattached to curtain 20, to replace the contaminated covering.

Protective covering 1 of the present invention is not a substitute for routine cleaning of privacy curtains, but it does provide a significant protection from the spread of infection and contamination on the curtains between washings of the curtain. Because protective covering 1 is made of material which is economical to manufacture and readily disposable, it is a cost efficient way to accomplishing the objective of decreasing the potential spread of infection caused by microorganisms via hand contact.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A combination protective covering and moveable privacy curtain having a meshed upper section and a lower opaque curtain section with a lateral edge and side surfaces, said combination comprising:

a unitary, flexible material sheet having two lateral sections interconnected by a center crease, each lateral section having a top and bottom;

means for removeably attaching the top of the lateral sections, said means extending through the meshed upper section of the privacy curtain; and means to removeably attach the lateral sections to the side surfaces of the lower curtain section, whereby when the two attachment means secure the material sheet to the meshed upper section and the side surfaces of the privacy curtain, a segment of the lateral edge of the privacy curtain is positioned within the crease and the lateral sections of the covering overlay a portion of the side surfaces of the curtain to allow a user to grasp the lateral sections and move the privacy curtain.

2. The combination as in claim 1 wherein the means for removeably attaching the top of the lateral sections of the material sheet comprise snaps which extend through the meshed upper section.

3. The combination as in claim 1 wherein the means to attach the lateral sections to the lower curtain section comprises connectors located on the lateral section.

4. The combination as in claim 3 wherein the connectors comprise adhesive connectors.

5. The method of preventing the spread of infection on a privacy curtain having a meshed upper section and a lower primary opaque curtain section with a lateral edge and side surfaces, said method comprising:

providing a unitary flexible protective covering having two lateral sections interconnected by a center crease, each lateral section having a top and a bottom;

positioning the lateral edge of the lower curtain within the crease of the material sheet;

attaching the tops of the lateral sections of the protective covering through the meshed upper section of the privacy curtain;

attaching the lateral sections of the protective covering to the side surfaces of the lower curtain section;

grasping the protective covering overlaying the lateral surfaces of the privacy curtain and pulling said curtain to establish privacy on either side of the curtain;

detaching the protective covering from the meshed upper section and side surfaces of the privacy curtain, once the covering has become soiled or contaminated;

removing the protective covering from the privacy curtain;

disposing of the protective covering; and reattaching a clean protective covering to the meshed upper section and the side surfaces of the privacy curtain.

6. The method as in claim 5 wherein the protective covering is attached to and detached from the meshed upper section by means extending through the meshed upper section.

7. The method as in claim 5 wherein the attachment of the protective covering to the side surfaces of the privacy curtain is provided for by removeable attachment means between the lateral sections of the protective covering and the curtain.

* * * * *